United States Patent [19]

Franco et al.

[11] 4,209,076

[45] Jun. 24, 1980

[54] EXHAUST SILENCER FOR AN AGRICULTURAL TRACTOR

[75] Inventors: Luigi Franco, Turin; Giorgio Bertotti, Vinovo, both of Italy

[73] Assignee: Centro Ricerche Fiat S.P.A., Orbassano, Italy

[21] Appl. No.: 33,929

[22] Filed: Apr. 27, 1979

[30] Foreign Application Priority Data

May 17, 1978 [IT] Italy ..... 53327/78[U]

[51] Int. Cl.[2] ..... F01N 1/08

[52] U.S. Cl. ..... 181/272; 181/275

[58] Field of Search ..... 181/272, 275, 230, 255, 181/269, 273, 281

[56] References Cited

U.S. PATENT DOCUMENTS

| | | | |
|---|---|---|---|
| 1,998,385 | 4/1935 | Powell | 181/273 |
| 4,064,962 | 12/1977 | Hunt | 181/272 |
| 4,079,810 | 3/1978 | Prather et al. | 181/272 |
| 4,147,230 | 3/1979 | Ormond et al. | 181/272 |

*Primary Examiner*—L. T. Hix
*Assistant Examiner*—Benjamin R. Fuller
*Attorney, Agent, or Firm*—Sughrue, Rothwell, Mion, Zinn and Macpeak

[57] ABSTRACT

An exhaust silencer for an agricultural tractor having a diesel engine with a cylinder capacity 2.5 to 4 liters and developing a power of 50 to 75 HP has a cylindrical body of elliptical cross-section which is closed at each end by an end-wall and is subdivided internally into two resonance chambers and two gas expansion chambers by three dished baffle-plates, the third baffle-plate having two tubular ducts. To optimize the acoustic performance specific dimensions of the chambers, of the ducts, of a perforated induction pipe and of an outlet pipe are prescribed.

3 Claims, 3 Drawing Figures

EXHAUST SILENCER FOR AN AGRICULTURAL TRACTOR

The present invention relates to exhaust silencers for agricultural tractors.

More particularly, the invention is concerned with an exhaust silencer for an agricultural tractor having a diesel engine with a cylinder capacity between 2.5 and 4 liters and developing a power of 50 to 75 HP.

Known silencers have a hollow body which is closed at each end by a wall and subdivided internally by baffle-plates which are traversed by a perforated tube. Such known silencers are, therefore, costly to manufacture and, although they are acceptable in terms of noise suppression, they are unacceptable as regards engine power loss.

An object of the present invention is to avoid these disadvantages with a silencer which is of simple construction and, consequently, of low cost, and which, compared with known silencers, has an improved acoustic performance and which in use results in a smaller loss of engine power.

According to the present invention there is provided an exhaust silencer for an agricultural tractor, having a diesel engine with a cylinder capacity between 2.5 and 4 liters and a power rating of about 50 to 75 HP, comprising a hollow tubular body of elliptical cross-section closed at each end by a respective end-wall, said end-walls being traversed, respectively by a portion of an induction pipe and by a portion of an exhaust gas outlet pipe, characterised in that said body has internal dimensions of 195 millimeters along a larger axis, 90 millimeters along a smaller axis, and a length of 702 millmeters, said body comprising first and second resonance chambers having respective lengths of 55 and 87 millimeters and being defined by first and second dished baffle-plates, first and second expansion chambers arranged in series and having respective lengths of 320 and 240 millimeters, said expansion chambers being defined by a third dished baffle-plate having two tubular ducts with respective internal diameters of 30 millimeters, their centres being on said larger axis of said body at a distance, respectively, of 45 millimeters on each side of said smaller axis, said tubular ducts projecting for a length of 62 millimeters into said first expansion chamber and for a length of 37 millimeters into said second expansion chamber, and in that said portion of the induction pipe has an internal diameter of 45 millimeters and traverses the resonance chambers, being in communication with each said chamber by respective openings, said pipe projecting into the first expansion chamber for a length of 75 millimeters, said portion of the exhaust gas outlet pipe projecting into said second expansion chamber for a length of 31 millimeters and projecting beyond the respective end-wall for a length of 600 millimeters.

One embodiment of the invention will now be more particularly described, by way of example, with reference to the accompanying drawings, in which.

Figure 1:
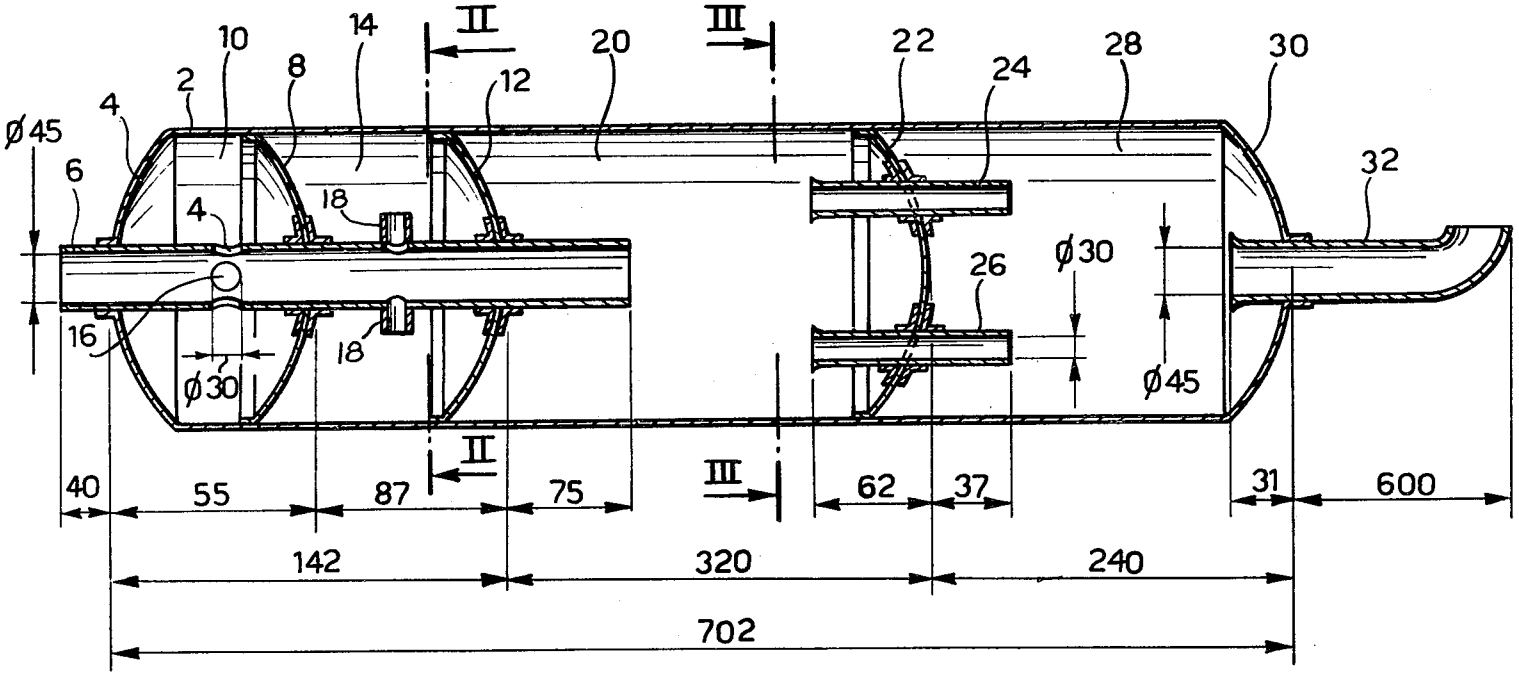
FIG. 1 is a longitudinal section of a silencer according to the present invention.

Referring now to the drawings, there is shown a silencer having a tubular body which is elliptical in cross-section, with dimensions of 195 millimeters along the larger axis and 90 millimeters along the smaller axis, and an overall length of 702 millimeters. The body is closed at one end by a convex end-wall 4 which is traversed centrally by an induction pipe 6 with an internal diameter of 45 mm, a portion of the pipe 6 projects for a length of 40 millimeters and is adapted for connection with the exhaust manifold of an engine (not shown). Within the silencer body 2, a portion of the induction pipe 6 traverses a first dished baffle-plate 8, concave towards the end-wall 4, which has a stiffening collar surrounding the pipe 6 and is placed at a distance of 55 millimeters from the end-wall 4 to define a first resonance chamber 10. The induction pipe 6 subsequently traverses a similar second dished baffle-plate 12, concave towards the baffle-plate 8, which is placed at a distance of 87 millimeters from the first plate 8 to define a second resonance chamber 14. The relative lengths of the two resonance chambers 10, 14 are so selected that the chambers are tuned to resonance at preselected frequencies present in the engine exhaust noise output.

Figure 2:
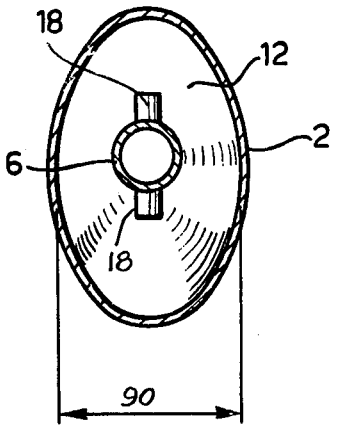
FIG. 2 is a cross-section taken along the line II—II of FIG. 1.

The induction pipe 6 is in communication with the first resonating chamber 10 through four, radially-arranged, angularly equidistant, ports 16, each with an internal diameter of 30 millimeters, and, with the second resonance chamber 14, through two, diametrically opposed tubes 18, each with an internal diameter of 14 millimeters and a length of 15 millimeters. The axes of the tubes 18 are coaxial with the said elliptical cross-section of the body 2, as shown in FIG. 2.

The induction pipe 6 extends for an additional 75 millimeters, opening into a first gas expansion chamber 20 defined by the second baffle-plate 12 and a third dished baffle-plate 22 located 320 millimeters therefrom.

Figure 3:
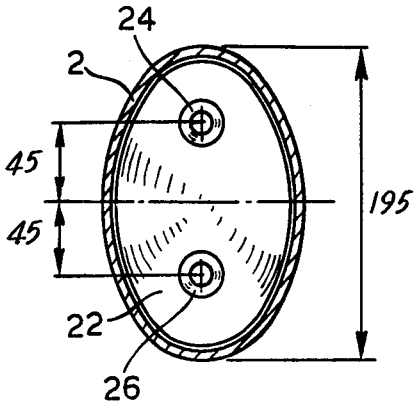
FIG. 3 is a cross-section taken along the line III—III of FIG. 1.

As shown in FIG. 3, the third baffle-plate 22 has two tubular ducts, comprising stub-pipes 24, 26, respectively. Each stub-pipe 24, 26 has a stiffening collar and an internal diameter of 30 millimeters. The pipes 24, 26 lie on the said larger axis of the body 2 at respective distances of 45 millimeters on each side of said smaller axis.

The stub-pipes 24, 26 project for a length of 62 millimeters into the first expansion chamber 20, having slightly flared ends, and project for a length of 37 millimeters into a second gas expansion chamber 28 defined by the third baffle plate 22 and an end wall 30 closing the other end of the silencer body 2, the chamber being 240 millimeters long.

The end wall 30 is traversed centrally by an exhaust gas outlet pipe 32 with an internal diameter of 45 millimeters which projects into the second expansion chamber 28 for a length of 31 millimeters. The internal end of the outlet pipe 32 is slightly flared and the pipe has an external length of 600 millimeters.

The silencer operates as follows: the exhaust gases pass from the engine into the silencer through the induction pipe 6, by which they are conducted through the resonance chambers 10, 14 in succession, the resonance chambers absorbing acoustic energy at the respective frequencies to which they are tuned so as to effect a two-stage reduction in the noise level of the gases. On entering the expansion chambers 20, 28, the gases are allowed to expand and are then compressed by the stub-pipes 24, 26 and the outlet pipe 32 before being discharged. The successive expansion of the gases in the expansion chambers 20, 28 serve to dissipate further the acoustic energy in the gases.

The described dimensions must not have a tolerance greater than ± 1 millimeter, in order to optimise the acoustic performance of the silencer.

What is claimed is:

1. Exhaust silencer for an agricultural tractor having a diesel engine with a cylinder capacity between 2.5 and 4 liters and a power rating of about 50–75 HP, comprising:

a hollow tubular body of elliptical cross-section;

respective end-walls closing the opposite ends of said body;

an induction pipe, a portion of which traverses one said end-wall, and an exhaust gas outlet pipe traversing the other said end-wall, wherein the improvements consists in said silencer body having internal dimensions of 195 millimeters along a larger axis, 90 millimeters along a smaller axis, a length of 702 millimeters and comprising:

a first dished baffle-plate located 55 millimeters from said one end-wall;

a first resonance chamber defined by said one end-wall and said first baffle-plate;

a second dished baffle-plate located 87 millimeters from said first baffle-plate;

a second resonance chamber defined by said first and second baffle-plates;

a third dished baffle-plate located 320 millimeters from said other end-wall;

a first gas expansion chamber defined by said second and third baffle-plates;

a second gas expansion chamber defined by said third baffle-plate and said other end-wall;

two tubular ducts supported by said third baffle plate and having respective internal diameters of 30 millimeters and respective centres lying on said larger axis at a distance of 45 millimeters on each side of said small axis, each said duct extending for a length of 62 millimeters into said first expansion chamber and for a length of 37 millimeters into said second expansion chamber, and wherein:

said resonance and expansion chambers are arranged in series longitudinally of said body;

said portion of said induction pipe has an internal diameter of 45 millimeters and extends through said resonance chambers to said first expansion chamber, projecting into the latter for a length of 75 millimeters;

said portion of said induction pipe has respective aperture means communicating with the respective said resonance chambers, and said exhaust gas outlet pipe has a portion which extends into said second expansion chamber for a length of 31 millimeters, said outlet pipe extending beyond said other end wall for a length of 600 millimeters.

2. Silencer as defined in claim 1, wherein said respective aperture means communicating with said first resonance chamber comprise four, radially arranged, angularly equidistant ports, each with an internal diameter of 30 millimeters.

3. Silencer as defined in claim 1, wherein said respective aperture means communicating with said second resonance chamber comprise two diametrically opposed tubes, each with an internal diameter of 14 millimeters and a length of 15 millimeters.

* * * * *